US005383392A

United States Patent [19]

Kowalewski et al.

[11] Patent Number: 5,383,392

[45] Date of Patent: Jan. 24, 1995

[54] SHEET REGISTRATION CONTROL

[75] Inventors: James M. Kowalewski, Baltimore; Solomon D. Kaplan, Owings Mills; Boris M. Katz, Baltimore, all of Md.

[73] Assignee: Ward Holding Company, Inc., Wilmington, Del.

[21] Appl. No.: 33,097

[22] Filed: Mar. 16, 1993

[51] Int. Cl.[6] ..... B41F 5/02; B41F 1/28

[52] U.S. Cl. ..... 101/183; 101/485

[58] Field of Search ..... 101/183, 185, 181, 232, 101/219, 484, 211, 485, 486; 271/198, 199, 202

[56] References Cited

U.S. PATENT DOCUMENTS

| | | |
|---|---|---|
| 4,095,511 | 6/1978 | Woolston . |
| 4,458,893 | 7/1984 | Ruh . |
| 4,471,693 | 9/1984 | Tsukasaki . |
| 4,494,745 | 1/1985 | Ward, Sr. et al. . |
| 4,515,079 | 5/1985 | Dahlgren . |
| 4,527,788 | 7/1985 | Masuda . |
| 4,567,824 | 2/1986 | Dahlgren et al. . |
| 4,604,083 | 8/1986 | Barny et al. . |
| 4,632,378 | 12/1986 | Sardella . |
| 4,774,446 | 9/1988 | Salazar et al. . |
| 4,847,775 | 7/1989 | Roch et al. . |
| 5,074,539 | 12/1991 | Wells et al. . |
| 5,094,442 | 3/1992 | Kamprath . |
| 5,103,733 | 4/1992 | Drapatsky . |
| 5,213,036 | 5/1993 | Takuno et al. . |

FOREIGN PATENT DOCUMENTS 2083449 3/1982 United Kingdom ..... 101/183

OTHER PUBLICATIONS

"Board Converting News" published 14 Jan. 91, vol. 5, No. 1, pp. 1 & 2.

Brochure entitled "Autotron 275" by Crosfield Controls published before 1991.

*Primary Examiner*—J. Reed Fisher

*Attorney, Agent, or Firm*—Edward D. C. Bartlett; Ronald B. Sherer

[57] ABSTRACT

A sheet processing apparatus, for example for flexographic printing and die-cutting of corrugated paperboard container blanks, has first and second successive processing sections connected by a transfer section. The sheets are successively passed through the various sections in positional registrations therewith. A sensor senses a sheet while in the transfer section and provides a signal representative of the positional registration of the sheet in the transfer section. A computer system determines from the signal whether the sheet would enter the second section in correct positional registration for processing by the second section, and adjusts as necessary the positional registration of the sheet while in the transfer section to cause the sheet to enter the second section in correct positional registration therewith. Preferably, the transfer section is a vacuum conveyor independently driven by one or more electric servo motors, the conveyor being both accelerated and decelerated to adjust sheet registration.

13 Claims, 5 Drawing Sheets

SHEET REGISTRATION CONTROL

FIELD OF THE INVENTION

This invention relates to apparatus and method for successively passing sheets through successive processing sections while desirably maintaining register of each sheet through each processing section. The invention is particularly concerned with producing container blanks from sheets of corrugated paperboard.

BACKGROUND OF THE INVENTION

During the production of container blanks, sheets are successively passed through successive processing sections such as printing and die-cutting. Printing can have one, two, three or more printing sections and employ one or more colored inks. Another section may include creasing. These various sections are rotationally (i.e. angularly) timed relative to each other so that each sheet theoretically passes through each section in register therewith. As the various operating members of the processing sections rotate in contact with successive sheets, each section is intended to perform an operation in the correct position on the sheet. In this way, all the operations get superimposed on top of each other on the sheet to form the final product, e.g. a printed container blank. Should any operation not be correctly positioned on the sheet, then the sheet is said to be out of registration, or out of register, with that operation; and this produces an inferior processed sheet.

The maintaining of good registration of paperboard sheets in the production of color printed container blanks has become more-critical with high production speeds and demand for higher quality printing and color graphics.

SUMMARY OF THE INVENTION

The present invention is concerned with improving the accuracy of positional registration when sheets are successively moved through a plurality of processing sections.

A feature of the present invention is checking and adjusting registration in a transfer section between two consecutive processing sections.

This has the advantage of enabling any out-of-registration which may develop to be corrected before the sheet enters the next processing section. Even though all the processing sections may be in register with each other, a sheet can be displaced from correct registration by an operating member, by drag forces, or by slipping relative to a forwardly conveying member. The present invention provides a way for correcting such incorrect sheet registration that may develop, so mitigating any adverse effect upon the processed sheet.

The present invention is particularly applicable to apparatus in which adjacent sections are driven by different motors, for example when driving each section with its own computer controlled electric "servo" motor. However, the invention is also applicable to apparatus in which all, some, or most, of the sections are driven from a common drive, for example by way of gearing between sections or a shaft drive between sections.

Accordingly, therefore, there is provided by one aspect of the present invention a sheet processing apparatus having first and second sheet processing sections successively arranged with the second sheet processing section downstream of the first sheet processing section and a transfer section between the first and second sections for transferring sheets from the first section to the second section. Sensor means sense a sheet in the transfer section and provide a signal representative of positional registration of the sheet in the transfer section. Control means determine from the signal whether the sheet would enter the second section in correct positional registration for processing by the second section, and adjust as necessary the positional registration of the sheet in the transfer section to cause the sheet to enter the second section in correct positional registration therewith.

The transfer section may comprise a driven conveyor.

The control means may include adjusting means for accelerating and decelerating the conveyor.

The control means may include adjusting means for changing the driven conveyor to correct any skew disposition of the sheet.

Preferably, a transfer section sensor indicates board position, and program logic control of the machine measures any error between machine timing and the signal from the sensor and then adjusts the transfer section to eliminate the error.

The adjusting means may function, responsive to the signal, to accelerate the conveyor in its direction of travel before the sheet enters the second section, and then after such acceleration to decelerate the conveyor in its direction of travel before the next sheet enters the transfer section from the first section.

Preferably, the conveyor is independently driven by at least one computer controlled servo motor.

Preferably, the controls means includes adjusting means for accelerating and decelerating the drive of the transfer section, and the adjusting means functions in response to the signal to accelerate and decelerate the transfer section drive before the sheet enters the second section.

The adjusting means may function, responsive to the signal, to advance one side of the conveyor in its direction of travel relative to the other side to correct any skewness of the sheet before the sheet enters the second section. To achieve this one side of the conveyor can be accelerated and then decelerated relative to the other side; at the same time both sides may be additionally accelerated and retarded to correct angular registration.

Preferably, the transfer section comprises a vacuum conveyor having at least one pair of endless belts with vacuum apertures therein, means for adjustably displacing one of the belts relative to the other to position the vacuum apertures in accordance with a predetermined sheet size, and the control means may function to drive both of the belts at the same speed when transferring each sheet from the first section to the second section.

The drives to the various processing sections, although preferably individual servo motors, may be gearing or other transmissions from a shared or common main drive motor.

According to another aspect of the present invention there is provided a method of processing sheets, comprising the steps of feeding sheets successively in correct registration to a first processing section, passing the sheets successively through the first processing section while carrying out a first process on each sheet, conveying the sheets successively from the first processing section to a second processing section, passing the sheets successively through the second processing section while carrying out a second process on each sheet, determining during the conveying step whether each sheet will enter the second processing section in correct registration therewith, and if not, then adjusting the registration of that sheet during the conveying step to cause that sheet to enter the second processing section in correct registration therewith.

Adjusting the registration of that sheet may be achieved by accelerating the sheet while travelling in its direction of travel followed by decelerating the sheet while still travelling in its direction of travel. The adjusting of the registration may comprise correcting any skewness of the sheet by advancing one side of the sheet relative to an opposite side of the sheet. The adjusting may correct both longitudinal (i.e. angular) registration and skewness registration.

There may be more than two successive processing sections, and the conveying step may occur between every two adjacent processing sections with registration of each sheet being checked and corrected during each conveying step.

The invention is particularly applicable to container blank processing apparatus having at least one or more flexographic printing sections and one or more other processing sections. Each processing section may advantageously be driven by its own computer controlled servo motor, and a transfer section used between adjacent processing sections to check and correct, as necessary, registration of each sheet leaving one section and before the sheet enters the next section.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters indicate like parts.

DETAILED DESCRIPTION OF THE PREFERRED EMBODIMENT

Figure 1:
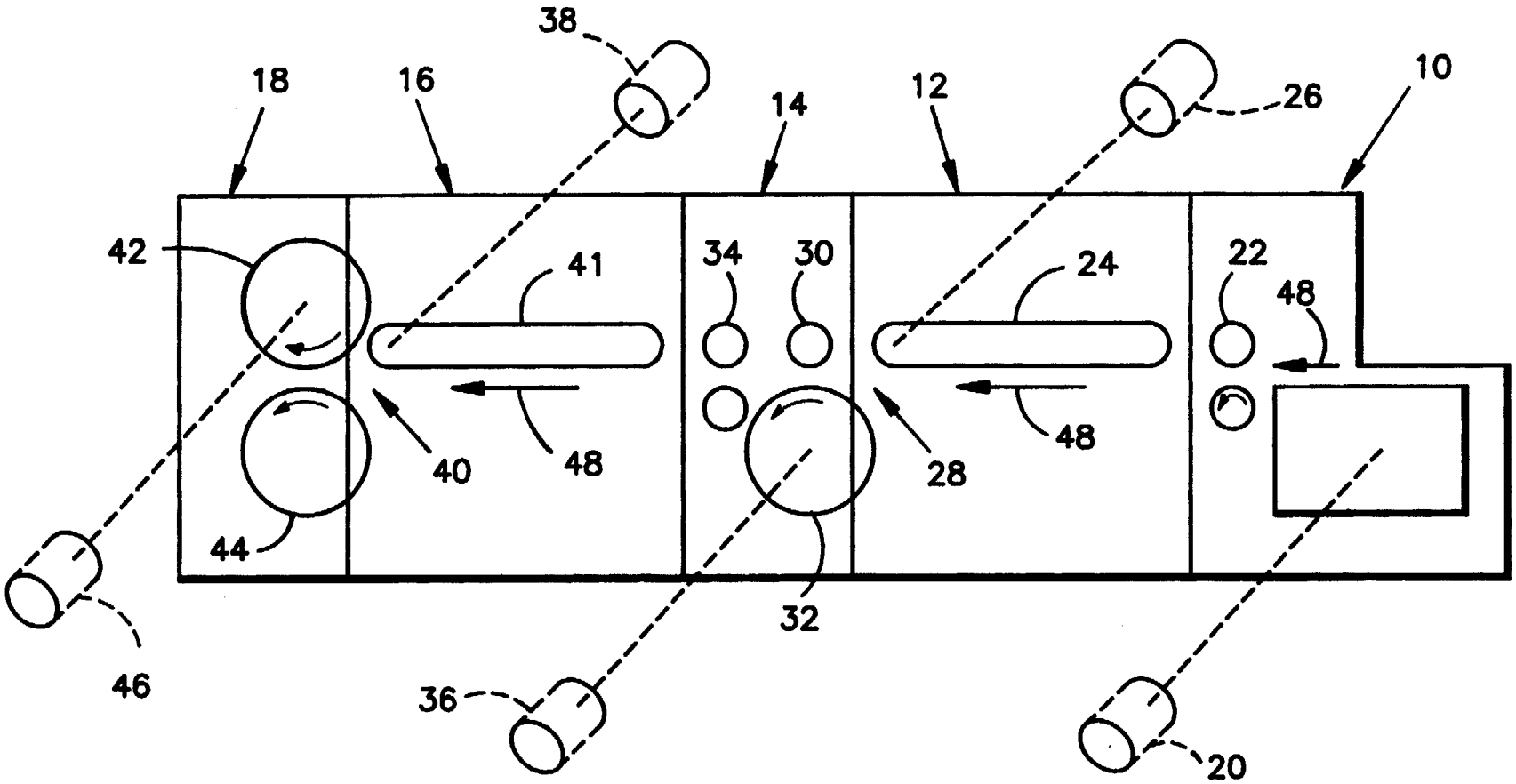
FIG. 1 is a diagrammatic side view of a sheet processing apparatus according to the invention.
Figure 2:
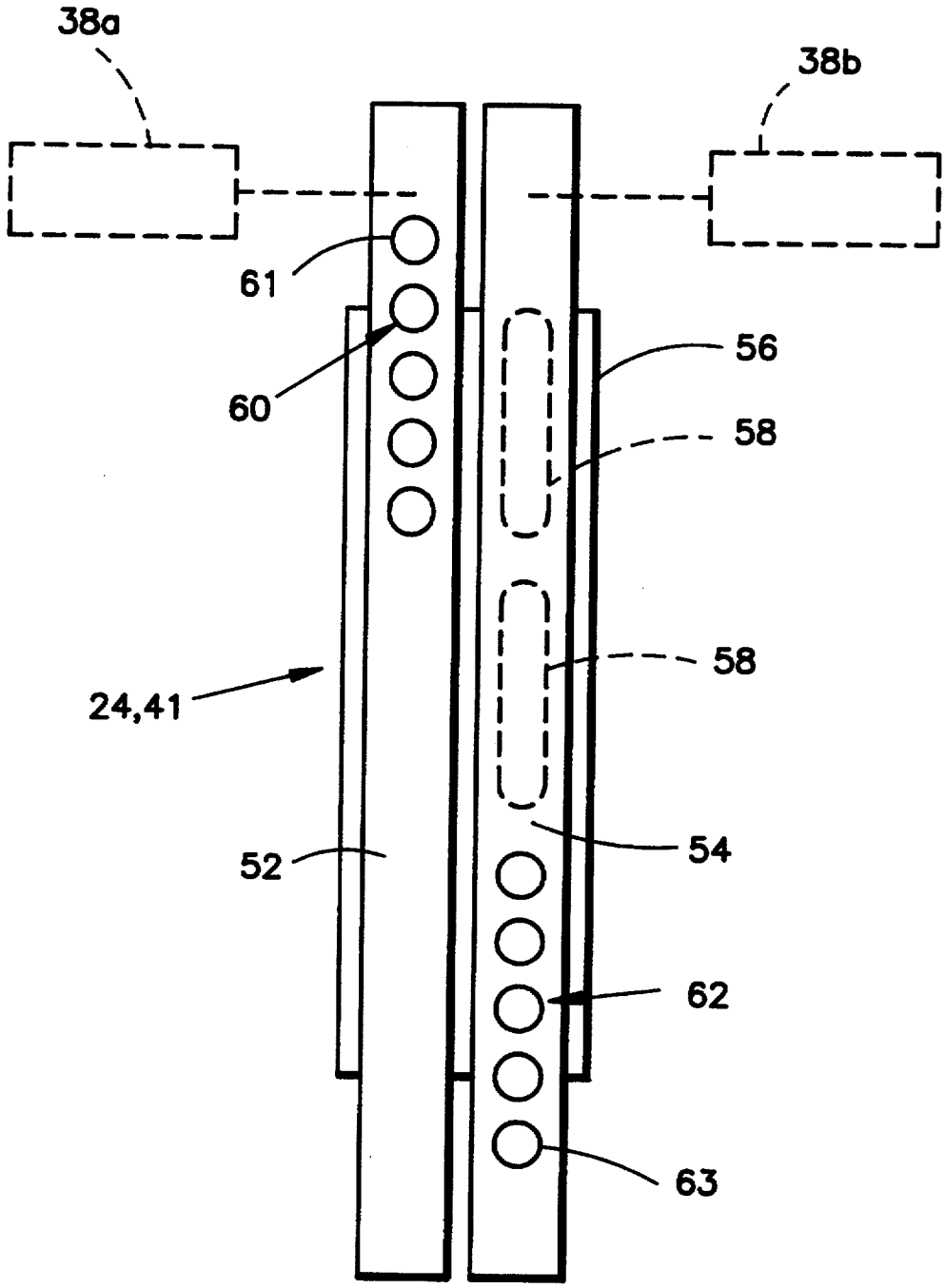
FIG. 2 is a simplified bottom plan view of a preferred transfer section of the apparatus of FIG. 1.
Figure 3:
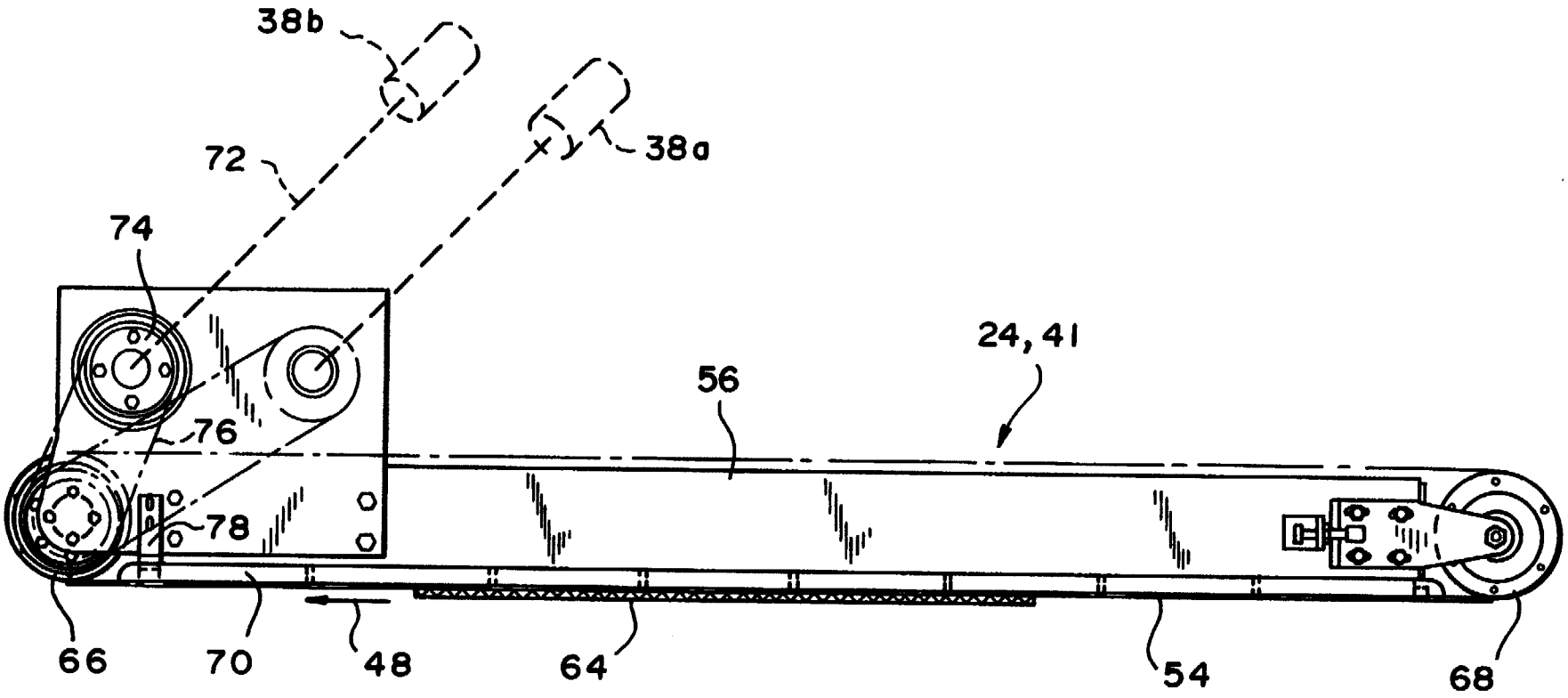
FIG. 3 is a side view of the preferred transfer section of FIG. 2.

The preferred embodiment of the invention is illustrated in FIGS. 1 to 5 and is a flexographic die-cut machine for producing printed container blanks from sheets of corrugated paperboard. A preferred transfer section is shown in FIGS. 2 and 3.

FIG. 1 illustrates the flexographic die-cut machine having a lead-edge feed section 10, a first transfer section 12, a flexographic printing section 14, a second transfer section 16, and a die-cut section 18. The feed section 10 may be as more fully disclosed in U.S. Pat. No. 4,494,745 or preferably U.S. Pat. No. 5,074,539 but is driven by its own individually controlled electric servo motor 20. A pair of pull rolls 22 grip each sheet fed from the lead-edge feeder and forward the sheet to the transfer section 12. The transfer section 12 is an overhead vacuum conveyor 24 and is independently driven by a servo motor 26. A sensor 28, preferably a high speed photo sensor, is positioned intermediate the length of, and adjacent the discharge end of, the conveyor 24. The sensor may be positioned below or above the board line. The conveyor 24 delivers the sheets successively between an impression roll 30 and a print cylinder 32 of the flexo section 14, feed rolls 34 then feeding each sheet to the second transfer section 16 which is the same as the first transfer section 12. The flexo section 14 is driven by an individually controlled electric servo motor 36, and the second transfer section 16 is independently driven by a servomotor 38. The second transfer section 16, which has a sensor 40 the same as the sensor 28 and a vacuum conveyor 41 the same as the conveyor 24, feeds each sheet through the nip of a die-cut roll 42 and an anvil roll 44, these rolls of the die-cut section 18 being driven by a servo motor 46. The sheets are fed in the direction of the arrows 48, and the directions of rotation of various rolls are shown by arrows. The various servo motors are controlled by a computer 50 (see FIG. 4).

In operation, the leading edge of a sheet while being transported by conveyor 24 is sensed by the sensor 28. The computer 50 (FIG. 4) determines whether the sheet is in register with the flexo section 14. If not, then after the trailing edge of the sheet has exited the pull rolls 22, and before the leading edge of the sheet enters the nip of the impression roll 30 with the print cylinder 32, the conveyor belt or belts of the vacuum conveyor 24 are accelerated and decelerated in the longitudinal feed direction 48 to correct the registration of the sheet while in and being conveyed through the transfer section 12. When a sheet is out of register, it usually lags behind the correct registration position, and so the conveyor 24 will be accelerated first and then decelerated back to line speed to make the registration correction. However, should a sheet be ahead of the correct registration, then the conveyor would be decelerated first from line speed and then accelerated back to line speed to make the registration correction. In this way, registration in the direction the sheet is being conveyed (i.e. angular registration) is corrected as necessary before the sheet is engaged in the next processing section. The sensor 40 and conveyor 41 operate in the same way to correct as necessary the angular registration of the sheet while in the second transfer section 16 before the sheet enters the nip between the anvil roll 44 and cutting roll 42.

The machine may have different or additional sections such as further flexo sections, a creasing and slotter section, a gluer-folder section, etc. with an individually driven transfer section between each pair or any pair of adjacent sections for correcting between such pair of adjacent sections any out-of registration of a sheet.

FIG. 2 is an underneath plan view of a preferred form of the vacuum conveyors 24 and 41. In the preferred form, instead of being single conveyor belts, these conveyors 24, 41 each comprise two side-by-side endless conveyor belts 52, 54 having a high coefficient of friction. These belts run around a vacuum box 56 connected continuously to a source of vacuum. The vacuum box is provided with a line of slotted apertures under each of the belts 52, 54 for communicating vacuum to the belts, two of such slotted apertures 58 being illustrated in broken lines under the belt 54. The belts 52, 54 each have therealong a group of apertures 60, 62 with the group of apertures 60 being spaced ahead of the group of apertures 62. Each belt 52, 54 only acts upon a sheet to convey the sheet when one or more of the apertures in the belt communicate with one or more of the slotted apertures 58 in the vacuum box. Two, three or four of these pairs of belts 53, 54 are spaced apart transversely across each transfer section 12, 16 to act upon each sheet adjacent the sheet's outer edges and preferably additionally midway or partway between the sheet's outer edges. For further details of timed conveyor belts for positioning carton blanks see U.S. Pat. No. 4,632,378 which is incorporated herein by reference.

Each belt 52, 54 is driven by a separate electric servo motor 38*a*, 38*b*. When setting-up for a particular size sheet, one of the servo motors 38*a*, 38*b* is operated to move the belts 52, 54 relative to each other until the leading aperture 61 of the group 60 and the trailing aperture 63 of the group 62 are spaced apart just less than the dimension of such sheet parallel to the conveyors 52, 54. Thus, the group of apertures 60 grip the sheet adjacent its leading edge and the group of apertures 62 grip the sheet adjacent its trailing edge. Whether there is a gap between the groups of apertures 60, 62 or whether the groups partially overlap depends upon the sheet size. As will be appreciated from FIG. 1, the sheets are being conveyed below the transfer conveyors 24, 41 (in the positions of the arrows 48). By applying vacuum via the groups of apertures 60, 62 to the leading and trailing sections of each sheet, the trailing section is prevented from falling away, or dropping down from, the conveyor 24, 41 and there is no wastage of vacuum by a vacuum aperture not being covered.

Once the correct spacing apart of the apertures 61, 63 has been achieved, the servo motors 38*a*, 38*b* then are operated at the same speed so that the belts 52, 54 move in unison and retain the relative positions of the apertures 61, 63. They move in unison during transfer conveying of sheets and also during correction of register.

With the two or more pairs of belts 52, 54, the one servo motor 38*a* may drive all the lefthand (FIG. 2) belts 52 and the one servo motor 38*b* may drive all the righthand belts 54. However, if the facility to also adjust any out-of-skew of the sheets is required, then each pair of belts 52, 54 would have its own individual pair of servo motors 38*a*, 38*b* to enable one pair of belts 52, 54 while moving in unison to be adjusted in longitudinal position relative to another pair of belts 52, 54 also moving in unison.

FIG. 3 shows a side view from the right in FIG. 2 of the preferred vacuum conveyors 24, 41. A corrugated paperboard container blank 64 is shown drawn against and being conveyed by the conveyor belt 54. Pulleys 66, 68 support the conveyor belt at each end, and the lower flight of the belt 54 runs in a longitudinal groove in the lower surface of a wear plate 70 of the vacuum box 56. The servo motor 38*b* drives the pulley 66 via a transmission connection 72, a pulley 74, and a timing belt 76. The servo motor 38*a* similarly drives the forward pulley (hidden behind pulley 66) of the conveyor belt 52 (hidden behind belt 54). The preferred location of sensors 28, 40 is shown at 78 above the lower flight of the conveyor belt 54, adjacent the pulley 66, and just back from the leading edge of the wear plate 70. The sensor at 78 senses the leading edge of the blank 64 as the blank passes under the sensor.

The sensors 28, 40 are preferably located above the board line, and so directed downwardly, as they are then less likely to be susceptible to contamination by dust and scrap coming from the sheets being processed. However, after the first sensor 28 senses the leading edge of a blank sheet fed from the feed section 10, the sheet is then printed in the (or the first) flexo section 14. At this stage, it is possible to print the sheet while in the section 14 with a registration mark. The registration mark (or marks) could be located anywhere on the sheet, but would preferably be at the periphery of the printed matter on the sheet, possibly in an area to be subsequently scrapped, e.g. during die-cutting. As in the embodiments of FIGS. 1 and 3 the printing is on the lower side of the sheet, the subsequent sensor 40 would be below the board line and facing upward when used to sense a registration mark printed on the sheet in flexo section 14. Of course, if printing were arranged to be on the upper side of the sheet, then the subsequent sensors 40 would be located above the board line to sense printed registration marks. When correcting skew registration, registration marks may be printed adjacent opposite sides of the sheet.

Figure 4:
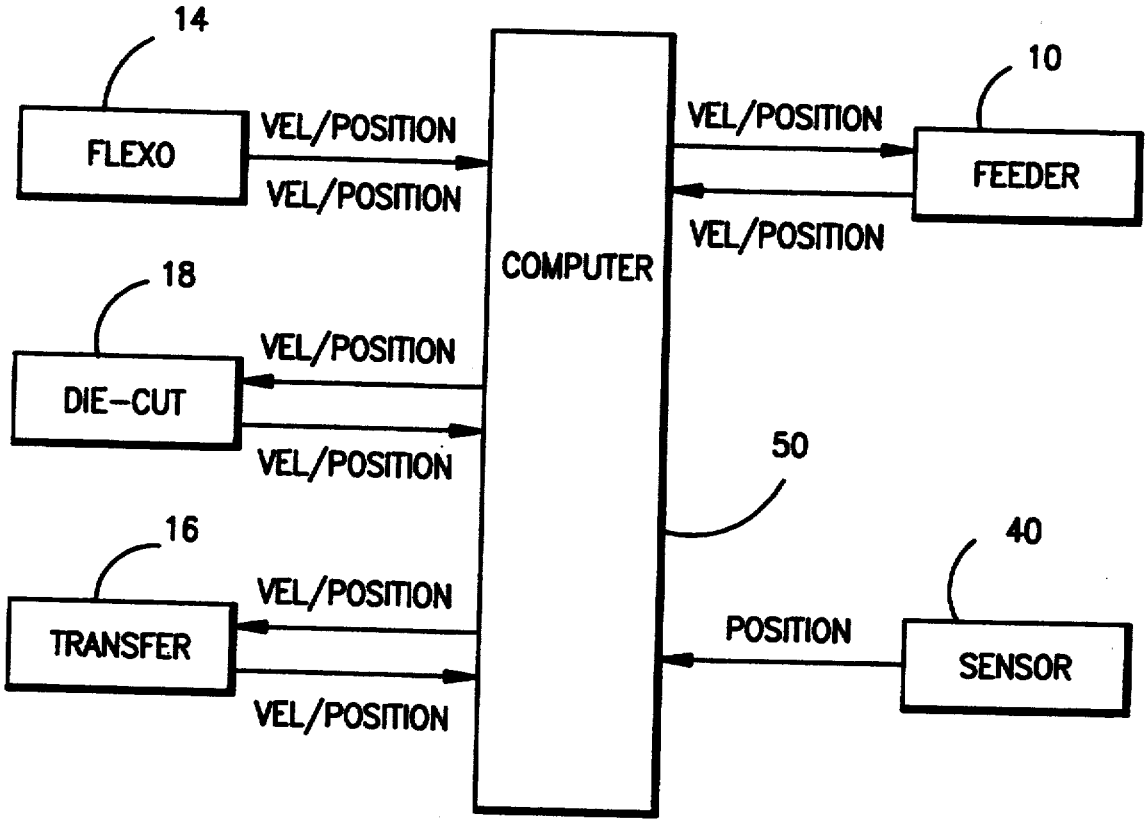
FIG. 4 is a block diagram illustrating the computer control system of the apparatus of FIG. 1.

FIG. 4 illustrates the computer 50 which is located in a control panel of the flexographic die-cut machine of FIG. 1. The timing of the machine for correct registration through each of the sections is determined from the flexographic printing section 14 which sends both a velocity and angular position registration signal to the computer 50. Using this signal, the computer sends a combined velocity and positional registration signal to the servo motors of the sheet feed section 10 and the die-cut section 18. Both these sections 10, 18 send feed back signals to the computer to check (and if necessary correct) their velocities and timing (theoretical registration). Based on the signal received from the die-cut section 18, the computer 50 sends a velocity and positional registration signal to the servo motors of the transfer section 16, and the computer receives a feed back signal to check (and correct if necessary) the velocity and registration timing of the conveyor belts 52, 54. The sensor 40, upon detecting the leading edge of a blank 64, sends a positional signal to the computer 50. The computer uses this signal to check whether this blank is in the correct position in the transfer section 16 to enter the die-cut section 18 in registration therewith; if not, then the computer sends a position adjust signal to the servo motors of the transfer section 16 to correct the position of the blank by rapid acceleration followed immediately by deceleration, the complete correction being accomplished while the lead edge of the blank 64 travels the distance between the sensor 40 and the nip of the rolls 42, 44.

It will be appreciated that the trailing edge of the blank should be clear of control of the previous section before such acceleration and deceleration occurs. If the sections are at 66 inch (168 cm) centers, and a maximum board dimension of 61 inches (155 cm) is to be accommodated, then the distance available for this acceleration and deceleration is only about 5 inches (13 cm). The sensor 40 could be moved beyond the discharge end of the conveyor 41, but this would shorten the distance for the acceleration and deceleration so requiring higher values for both and larger servo motors. With the arrangement of FIG. 2 and 3, Indramat servo motors MAC 112 were employed for servos 38*a*, 38*b*, these being constant torque variable speed electric motors. For digital control, it is preferred to use Indramat servo motors MDD 112.

Figure 5:
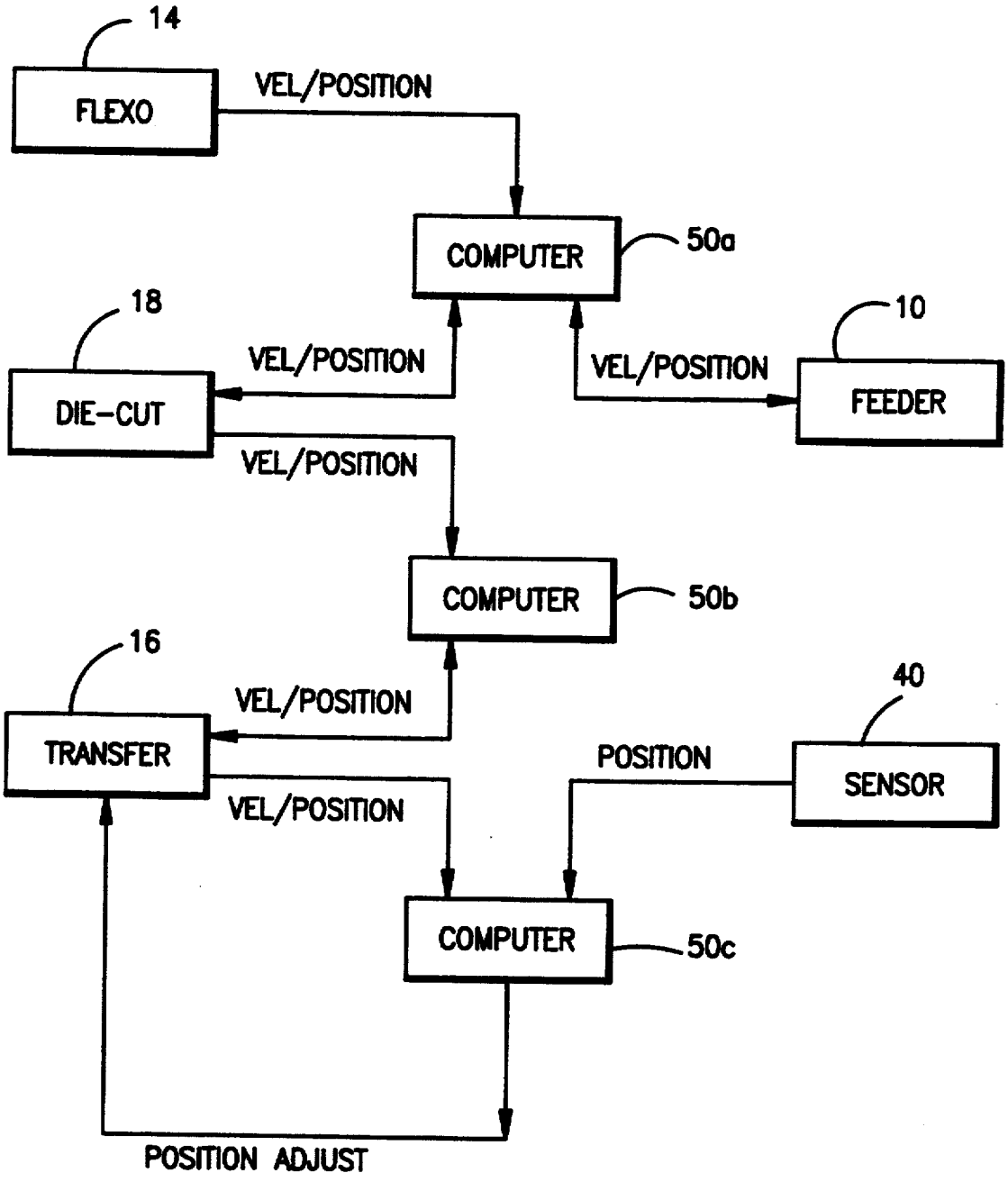
FIG. 5 is the block diagram of FIG. 4 illustrated in a different way to facilitate understanding the invention.

FIG. 5 illustrates the computer control system in a somewhat expanded manner. The controlling velocity/position signal is fed from flexo section 14 to a first part 50a of the computer 50. This computer part 50a then feeds velocity/position signals to the servo motors of the die-cut section 18 and the feed section 10, and receives feed back signals from these sections. The die-cut section 18 sends a further velocity/position signal to a second part 50b of the computer 50 which in turn sends a velocity/position signal to the servo motors of the transfer section 16 and receives a feed-back signal from the transfer section 16. The transfer section 16 sends an output velocity/position signal to a third part 50c of computer 50, and a position signal is fed to this computer part 50c from the sensor 40; if the position signals are not the same, the computer part 50c sends a position adjust signal to the servo motors of the transfer section 16 to effect the necessary acceleration and deceleration to correct the position of the blank 64, i.e. to bring the blank 64 into registration with the die-cut section 18 before the blank comes under the control of that section.

The computer parts 50a, *b* and *c* may be parts of one computer or may be several computers packaged together.

The transfer section 12 was omitted from FIGS. 4 and 5 for simplicity. It will be understood that the transfer section 12 is controlled similarly to the transfer section 16, but with the controlling signal for the transfer section 12 coming via the computer from the flexo section 14 and not the die-cut section 18.

It will be appreciated that for whatever reason a sheet blank approaches a processing section out-of register therewith, the registration can be corrected while the blank is in the transfer section approaching the processing section. Whereas the main need due to slippage etc. is to correct angular registration with the next processing section, as explained above it is also possible to correct skew registration if desired. However, correction of skew errors requires more drive complexities than just correcting angular (phase) registration.

The above described embodiments, of course, are not to be construed as limiting the breadth of the present invention. Modifications, and other alternative constructions, will be apparent which are within the spirit and scope of the invention as defined in the appended claims.

For example, instead of accelerating and then decelerating (or decelerating and then accelerating) the driven pulley 66 of the conveyor belt 54, a servo motor may change the configuration of the path of the conveyor belt to advance or retard the lower flight so adjusting the positional registration of the blank thereon. This could be done using a ball screw and nut arrangement driven by the servo motor for moving a belt idler pulley about the rotational axis of a drive pulley of the belt with the drive pulley being located above the vacuum box and partway along the upper flight of the belt.

What is claimed is:

1. A sheet processing apparatus, comprising:

a first sheet processing section;

a second sheet processing section;

a transfer section positioned entirely between said first and second sections;

drives connected to said first and second sections;

at least one motor connected to said transfer section and operable independently of said drives to operate said transfer section at a predetermined line speed;

sensor means, associated with said transfer section, for sensing a sheet in said transfer section and providing a signal indicative of registration of the sheet in the transfer section; and control means for determining from said signal whether the sheet is in register with said second section, and if not, then increasing and immediately decreasing the speed of said transfer section relative to said line speed to adjust the registration of the sheet while in the transfer section to cause the sheet to enter said second section in register therewith.

2. The apparatus of claim 1, wherein:

said first section is a flexographic printing section; and said second section is a die-cutting section.

3. A sheet processing apparatus, comprising:

first and second sheet processing sections successively arranged with the second sheet processing section downstream of the first sheet processing section;

a sheet transfer section positioned entirely between said first and second sections;

drive means for operating said transfer section at a given line speed;

sensor means for sensing a sheet in said transfer section and providing a signal representative of positional registration of the sheet in the transfer section; and control means for determining from said signal whether said sheet would enter said second section in correct positional registration for processing by said second section, and for adjusting if necessary the speed of said sheet while in said transfer section first above and then immediately below said line speed to cause said sheet to enter said second section in correct positional registration therewith.

4. The apparatus of claim 3, wherein:

said sheet transfer section comprises a driven conveyor for conveying the sheet in a direction of travel from said first sheet processing section to said second sheet processing section; and said control means includes adjusting means for accelerating and decelerating said conveyor in said direction of travel.

5. The apparatus of claim 4, wherein said adjusting means functions, responsive to said signal, to accelerate said conveyor before said sheet enters said second section, and then after such acceleration to decelerate said conveyor before the next sheet enters said transfer section from said first section.

6. The apparatus of claim 3, wherein the sheets to be processed have a predetermined size, and wherein said transfer section comprises:

a vacuum conveyor having at least one pair of endless belts having a series of vacuum apertures therein;

means for adjustably displacing one of said belts relative to the other to position said two series of vacuum apertures in accordance with said predetermined sheet size; and said control means functioning to drive both of said belts at the same speed when transferring each sheet from said first section to said second section.

7. The apparatus of claim 3, wherein:

said control means includes adjusting means for accelerating and decelerating the motor drive of said transfer section; and said adjusting means functions in response to said signal to accelerate and decelerate said transfer section motor drive before said sheet enters said second section.

8. Apparatus for producing container blanks from sheets of corrugated paperboard of different sizes by performing successive operations on the sheets as they pass through successive operating stations in positional register therewith, the apparatus comprising:

a sheet feeder;

a flexographic printing section having a rotatable printing cylinder carrying a printing die;

a rotary die-cut section;

a transfer section located entirely between said flexographic printing section and said rotary die-cutter;

said transfer section comprising a vacuum box, a pair of side-by-side conveyor belts having vacuum apertures therein, and two electric motors;

one of said motors being drivingly connected to one of said belts, and the other of said motors being drivingly connected to the other of said belts;

means for rotating one of said motors relative to the other for adjusting the position of the vacuum apertures in one of the belts relative to the vacuum apertures in the other of said belts for securing different size sheets adjacent the leading and trailing portions thereof;

a sensor located in said transfer section and producing a signal indicative of positional register of a sheet while passing through said transfer section; and control means, including a computer, for receiving said signal and determining whether said sheet is in register with said die-cut section, and if out of register, accelerating and immediately decelerating said two motors in unison before said sheet enters said die-cut section to bring said sheet into register for said die-cut section.

9. A method of processing sheets, comprising the steps of:

feeding individual sheets successively in correct registration to a first processing section;

passing the sheets successively through said first processing section while carrying out a first process on each sheet;

conveying the sheets successively from said first processing section to a second processing section at a predetermined line speed;

passing the sheets successively through said second processing section while carrying out a second process on each sheet; and determining during said conveying step whether each sheet will enter said second processing section in correct registration therewith, and if not, changing the conveying speed from said line speed and returning the conveying speed to said line speed during said conveying step sufficiently to cause that sheet to enter said second processing section in correct registration therewith.

10. The method of claim 9, wherein said adjusting the registration of that sheet comprises accelerating that sheet in its direction of travel followed by decelerating that sheet.

11. Apparatus for printing and performing subsequent functions on successive sheets of paperboard comprising:

a first section for performing a printing function on said sheets;

a second section for performing a subsequent function on said sheets;

a transfer section for transferring successive sheets from said first section to said second section, said transfer section extending only between said first and second sections;

first drive means connected to operate said first and second sections;

second drive means, operable independently of said first drive means, for operating said transfer section at a predetermined line speed;

sensor means for sensing the position of a sheet while said sheet is in said transfer section; and computer control means for determining from said signal whether said sheet is in register with said second section, and if not, for changing the speed of said transfer section from said line speed, and immediately returning said speed to said line speed, while said sheet is in said transfer section, sufficiently to cause said sheet to enter said second section in register therewith.

12. Apparatus for processing sheets of material comprising:

first and second operating sections;

drive means for operating said sections;

transfer means positioned between said sections for transferring sheets successively from said first section to said second section;

motor means for operating said transfer means independently of the speed of said drive means;

sensor means for producing a signal indicative of the registry of a sheet located in said transfer means relative to said second section;

control means connected to said motor means for changing the speed of said transfer means in response to said signal, when a sheet is out of registry, so as to correct the registry of said sheet;

said transfer means including at least two side-by-side conveyor belts, each of said side-by-side belts having at least one vacuum aperture positioned along a portion of the length of the belt;

means for adjusting the lengthwise position of one of said vacuum apertures relative to said other vacuum aperture depending upon the length of the sheets to be transferred such that the leading portion of a sheet is secured by one of said vacuum apertures and the trailing portion of the same sheet is secured by the other of said vacuum apertures; and means for operating both belts at the same speed to transfer sheets in registry from said first section to said second section.

13. The apparatus of claim 12 wherein said means for operating both belts comprise a pair of servo motors, one of said servo motors being connected to drive one of said belts and the other servo motor being connected to drive the other of said belts.

* * * * *